US010544487B2

(12) United States Patent
Behdad et al.

(10) Patent No.: US 10,544,487 B2
(45) Date of Patent: Jan. 28, 2020

(54) AGE-HARDENABLE MAGNESIUM ALLOYS

(71) Applicants: Sadegh Behdad, Miami, FL (US); Benjamin Boesl, Miami, FL (US); Arvind Agarwal, Miami, FL (US)

(72) Inventors: Sadegh Behdad, Miami, FL (US); Benjamin Boesl, Miami, FL (US); Arvind Agarwal, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 729 days.

(21) Appl. No.: 14/984,331

(22) Filed: Dec. 30, 2015

(65) Prior Publication Data

US 2017/0191147 A1 Jul. 6, 2017

(51) Int. Cl.
*C22C 23/00* (2006.01)

(52) U.S. Cl.
CPC ..... *C22C 23/00* (2013.01)

(58) Field of Classification Search
CPC ..... C22C 23/00
USPC ..... 420/402
See application file for complete search history.

(56) References Cited

U.S. PATENT DOCUMENTS

| | | | | |
|---|---|---|---|---|
| 8,361,251 | B2 | 1/2013 | Luo et al. | |
| 2006/0013972 | A1* | 1/2006 | Nishiyama | C23C 14/20 428/34.1 |
| 2007/0204936 | A1 | 9/2007 | Kato et al. | |
| 2010/0050977 | A1 | 3/2010 | Park | |
| 2014/0154341 | A1 | 6/2014 | Manuel et al. | |
| 2014/0249531 | A1 | 9/2014 | Staunton | |
| 2014/0261911 | A1 | 9/2014 | Imwinkelried et al. | |

FOREIGN PATENT DOCUMENTS

| | | | |
|---|---|---|---|
| CN | 103882272 | A | 6/2014 |
| DE | 102005033750 | A1 | 2/2006 |
| JP | 08134581 | A * | 5/1996 |
| WO | WO 2012/003502 | A2 | 1/2012 |

OTHER PUBLICATIONS

NPL: On-line English-translation of JP 08134581 A (Year: 1996).*
NPL: On-line English translation of CN 103882272 A (Year: 2014).*
NPL-1: Behdad et al, Improvement of aging kinetics and precipitate size refinement in Mg—Sn alloys by hafnium additions, Materials Science & Engineering A 651 (2016), pp. 854-858, available online 1, Dec. 2015. (Year: 2015).*
Bhattacharjee, T. et al., "The effect of Ag and Ca additions on the age hardening response of Mg—Zn alloys," *Materials Science & Engineering A*, 2013, 575:231-240.
Elsayed, F.R. et al., "Compositional optimization of Mg—Sn—Al alloys for higher age hardening response," *Materials Science & Engineering A*, 2013, 566:22-29.
Liu, Hongmei et al., "The microstructure, tensile properties, and creep behavior of as-cast Mg-(1-10)%Sn alloys," *Journal of Alloys and Compounds*, 2007, 440:122-126.
Mendis, C.L. et al., "An enhanced age hardening response in Mg—Sn based alloys containing Zn," *Materials Science & Engineering A*, 2006, 435-436:163-171.

* cited by examiner

*Primary Examiner* — Jie Yang
(74) *Attorney, Agent, or Firm* — Saliwanchik, Lloyd & Eisenschenk

(57) ABSTRACT

The subject invention provides compositions of a family of magnesium alloys for various applications including but not limited to automotive, aerospace, and biomedical applications. Preferred embodiments provide that this family of alloys comprises elements readily available domestically while offering improved mechanical properties at approximately half the cost of similar commercial alloys that comprise rare earth (RE) elements. Advantageously, utilization of these new magnesium alloys in car engine parts would lead to better fuel economy and in turn, reduce carbon dioxide emissions and environmental damages from vehicles.

9 Claims, No Drawings

AGE-HARDENABLE MAGNESIUM ALLOYS

BACKGROUND OF INVENTION

Each year about 17 million new automobiles are introduced into the U.S. market. More than 95% of these automobiles run on conventional internal combustion engines. Federal regulations requiring reduction in automobile emissions have led many major auto manufacturers to invest in the development of light-weight metals and alloys. It is estimated that weight reduction from using lighter materials could result in saving almost 100 billion gallons of gasoline and also result in a reduction of 6.5 billion gallons of carbon dioxide emissions per year, just for passenger cars in the U.S.

There are many other uses for high strength, light-weight metals and alloys. For example, in the biomedical sector, there is an emerging market for load-bearing, light-weight, and biocompatible materials to provide support after temporary implants are re-absorbed.

Magnesium alloys have shown promising performances. See, for example, U.S. Pat. No. 8,361,251; U.S. Patent Publication No. 2007/0204936 A1; Gelman Publication No. 102005033750 A1; U.S. Patent Publication No. 2014/0261911 A1; U.S. Patent Publication No. 2014/0249531 A1; U.S. Patent Publication No. 2014/0154341 A1; and International Patent Publication No. WO 2012/003502 A2.

Magnesium, being the lightest of all structural metals, is almost one quarter the density of steel and two-thirds the density of aluminum. These properties make magnesium an excellent green alternative to replace metals and polymers in a variety of applications. The major hurdle in the utilization of magnesium, however, is the lack of affordable alloy compositions that exhibit proper creep resistance, including at elevated temperatures.

Current benchmark magnesium alloys are mainly of the Mg—Al alloy family including, for example, AZ91D, AM50A, and AM60B; however, precipitates formed in these alloys are not thermally stable above 125° C., significantly limiting their service temperatures. Currently, the main alternative alloy for elevated temperature applications is AE42, a Mg—Al based alloy comprising rare earth elements that can be used at service temperatures up to 170° C. Above this temperature, there is an abrupt degradation of creep resistance.

Because most rare earth elements are imported from overseas, the cost associated with AE42 and other similar alloys is very high. Furthermore, in the defense and aerospace markets, foreign suppliers of rare earth elements necessary for fabrication of current high-temperature Mg alloys, make this core technology vulnerable to interruption.

Therefore, there remains a need for magnesium alloys that can be made from more readily-available elements that can also be used for high-temperature and other applications.

BRIEF SUMMARY

The subject invention provides magnesium alloys that can be used for various automotive, aerospace, and biomedical applications. In preferred embodiments the alloys comprise elements readily available domestically, while offering improved mechanical properties at less cost than other alloys that comprise rare earth (RE) elements.

Advantageously, utilization of these new magnesium alloys in car engine parts leads to better fuel economy and a reduction in carbon dioxide emissions and other environmental damage from vehicles.

Specifically, embodiments of the subject invention provide a magnesium alloy comprising tin in an amount between about 0.1 and about 3.5 atomic percent (at %), one or more elements selected from hafnium, titanium, niobium, molybdenum, and vanadium in an amount between about 0.1 and 2.0 atomic percent, and the balance magnesium, optionally with trace amounts of mixer impurities that may be, for example, unavoidable.

In one embodiment, the magnesium alloy comprises tin in the amount of about 1.1 at %, hafnium in the amount of about 0.11 at %, with the balance being substantially magnesium.

In another embodiment, the magnesium alloy comprises tin in the amount of about 1.1 at %, hafnium in the amount of about 0.22 at %, with the balance being substantially magnesium.

In a further embodiment, the magnesium alloy comprises tin in the amount of about 2.2 at %, hafnium in the amount of about 0.11 at %, with the balance being substantially magnesium.

In yet another embodiment, the magnesium alloy comprises tin in the amount of about 2.2 at %, hafnium in the amount of about 0.22 at %, with the balance being substantially magnesium.

In some embodiments, the compositions provided herein are characterized in that the time-to-peak hardness measured in hours is reduced significantly in comparison with an alloy comprising tin in an amount between about 0.1 and about 3.5 at % and at the balance substantially magnesium.

DETAILED DISCLOSURE

The subject invention provides magnesium alloys that can be used for applications including, but not limited to, automotive, aerospace, and biomedical applications. Advantageously, these alloys comprise elements that are readily available domestically while offering improved mechanical properties at a lower cost than alloys that comprise rare earth (RE) elements. Furthermore, utilization of these new magnesium alloys in car engine parts leads to better fuel economy and reduced carbon dioxide emissions and other environmental damage from vehicles.

In the following embodiments, a commercial grade of "high-pure" magnesium is considered "substantially magnesium" with inclusions of impurities that are considered "unavoidable." These impurities typically include, at the maximum, approximately 0.3 wt % manganese, approximately 0.01 wt % silicon, approximately 0.01 wt % copper, approximately 0.002 wt % nickel, approximately 0.002 wt % iron, and/or approximately 0.02 wt % others. These "impurities" can be present in the compositions provided by the subject invention.

Specifically, embodiments of the subject invention provide a magnesium alloy comprising tin in an amount between about 1.0 and about 3.0 at %, one or more elements selected from hafnium (Hf), titanium (Ti), niobium (Nb), molybdenum (Mo), and vanadium (V) in an amount between about 0.1 and about 2.0 at %, and the balance magnesium, optionally with minor unavoidable impurities.

Without the inclusion of RE elements, Mg—Sn alloy compositions provided herein are excellent low-cost candidates for applications at temperatures equal to or even higher than that which can be used for Mg—Al—RE alloy AE42, while demonstrating good mechanical properties.

Table 1 shows a comparison between the estimated price of raw materials per unit weight for the preferred embodiments of Mg—Sn—Ti and Mg—Sn—Hf alloy compositions of the subject invention and select commercially available alloys intended for similar applications. It is clear that the alloys provided herein can be made at less cost than their Mg—RE alloy counterparts.

TABLE 1

Estimated cost of raw materials per unit weight for Mg—Sn based alloy compositions in comparison with their commercially available counterparts.

| Alloy | Mg—Sn—Ti | Mg—Sn—Hf | AE42 | WE43 | ZRE1 |
|---|---|---|---|---|---|
| Price (USD) | 14.8-15.4 | 17.7-21.4 | 32.36 | 91.94 | 50.42 |

Advantageously, compositions provided herein preferably do not comprise rare earth elements, thereby reducing both the cost and dependence on foreign natural resources to manufacture alloys with desirable properties.

In one embodiment, the magnesium alloy comprises tin in the amount of about 1.1 atomic percent (at %), hafnium in the amount of about 0.11 at %, with the balance being substantially magnesium. In another embodiment, the magnesium alloy comprises tin in the amount of about 1.1 at %, hafnium in the amount of about 0.22 at %, with the balance being substantially magnesium. In a further embodiment, the magnesium alloy comprises tin in the amount of about 2.2 at %, hafnium in the amount of about 0.11 at %, with the balance being substantially magnesium. In yet another embodiment, the magnesium alloy comprises tin in the amount of about 2.2 at %, hafnium in the amount of about 0.22 at %, with the balance being substantially magnesium. Exemplary embodiments of Mg—Sn—Hf compositions, with varying amounts of Sn and Hf, respectively, are listed in Table 2.

TABLE 2

Exemplary embodiments of Mg—Sn—Hf alloy compositions.

| | Atomic Percent | | | Weight Percent | | |
|---|---|---|---|---|---|---|
| Alloy Designation | Sn | Hf | Mg | Sn | Hf | Mg |
| T5 (Base alloy) | 1.1 | 0 | 98.9 | 5.15 | 0 | 94.85 |
| T5-0.8Hf | 1.1 | 0.11 | 98.79 | 5.12 | 0.77 | 94.11 |
| T5-1.5Hf | 1.1 | 0.22 | 98.68 | 5.08 | 1.53 | 93.39 |
| T10 (Base alloy) | 2.2 | 0 | 97.8 | 9.9 | 0 | 90.1 |
| T10-0.7Hf | 2.2 | 0.11 | 97.69 | 9.84 | 0.74 | 89.42 |
| T10-1.5Hf | 2.2 | 0.22 | 97.58 | 9.77 | 1.47 | 88.76 |

In some embodiments, the compositions provided herein are characterized in that the time-to-peak hardness measured in hours is reduced by approximately at least an order of magnitude in comparison with an alloy comprising tin in an amount between about 0.1 and about 3.5 at % and the balance substantially magnesium.

The inclusion of one or a combination of ternary elements, i.e., those elements in addition to Mg and Sn, in minute amounts of between about 0.1 at % and about 2.0 at %, significantly reduces the duration of time required for age hardening at elevated temperatures at, for example, approximately 200° C. (Table 3).

TABLE 3

Summary of ageing response and mechanical properties of Mg—Sn—Hf alloys at approximately 200° C.

| Alloy composition (wt %) | Time-to-peak hardness (h) | Max. Hardness (VHN) | Max. Increment in hardness (VHN) | Initial hardness (VHN) | Increase in hardness (%) |
|---|---|---|---|---|---|
| T5 (Base alloy) | 900 | 44.5 | 7.1 | 37.4 | 19.0 |
| T5-0.8Hf | 77 | 47.7 | 10.6 | 37.1 | 28.6 |
| T5-1.5Hf | 77 | 44.9 | 12.2 | 32.7 | 37.3 |
| T10 (Base alloy) | 220 | 53.9 | 14.1 | 39.8 | 35.4 |
| T10-0.7Hf | 49 | 57.0 | 16.8 | 40.2 | 41.8 |
| T10-1.5Hf | 96 | 58.1 | 18.0 | 40.1 | 44.9 |

The benefits of reduction of time required for heat treatment is two-fold. First, it reduces the costs of the energy consumption associated with manufacturing, which further reduces the unit price of the final alloy products. Second, the reduction of heat treatment time makes available options for manufacturing heat-treatable wrought alloys that can also be extruded.

Moreover, the addition of ternary elements such as Hf substantially improves the mechanical properties of the Mg alloys provided herein when compared to Mg—Sn binary alloys without any ternary elements, e.g., the T5 and T10 base alloys listed in Table 3.

Advantageously, the compositions provided herein can be applied to both cast and wrought alloys regardless of the specific alloying techniques employed to fabricate the alloys. In a specific embodiment, the compositions apply to cast alloys.

Following is an example that illustrates the aforementioned embodiments; it should not be construed as limiting. All of the chemical supplies provided herein, unless otherwise noted, were obtained via commercial sources and are readily available for procurement.

EXAMPLE 1—FABRICATION OF THE MG—SN—HF ALLOY

Details below describe procedures for fabricating an exemplary Mg—Sn—Hf alloy composition. Similar procedures can be followed for the synthesis of other alloy compositions provided in the subject invention.

Step 1: Mixing (Under Controlled Atmosphere)

A total of six samples of Mg—Sn—Hf alloy were made from high-purity magnesium chips (99.98 pct, Sigma-Aldrich), tin powder (99.85 pct, Alfa-Aesar), and hafnium powder (99.6 pct, Alfa-Aesar). Nominal compositions of the samples in both atomic percent (at %) and weight percent (wt %) are listed in Table 2. All of the samples were measured, mixed, and cast under high-purity argon atmosphere in a glovebox. Oxygen levels were monitored to be less than 10 ppm to prevent oxidation.

Step 2: Casting (Under Controlled Atmosphere)

Alloy samples were fabricated by melting in a resistance-heating furnace at about 750° C. Each molten mixture was stirred with a graphite rod after approximately 30 minutes to ensure proper mixing, and was cast after another 15 minutes in a graphite mold previously sprayed with hexagonal boron nitride, a high-temperature release agent.

Step 3: Encapsulation

Alloy samples were cut into small pieces and put in quartz tubes. Tubes were vacuumed and backfilled multiple times with hydrogen and argon to remove any remaining oxygen and moisture left therein. Quartz tubes were then partially pressurized with argon and sealed for solution treatment, i.e., homogenization.

Step 4: Solution Treatment (Homogenization)

For homogenization, alloy samples were heated to approximately 345° C. at a heating rate of about 80° C./hour and kept at that temperature for about 2 hours, then heated to about 500° C. at approximately 80° C./hour and kept at that temperature for about 6 hours. Samples were then quenched in cold water.

Step 5: Artificial Aging

After homogenization, age hardening behavior of the samples was studied by artificial aging in a silicone oil bath at about 200° C.

Because these alloying additions exert their effects in the solid state, they can be made via other methods including, but not limited to, melting under other controlled atmospheres, melting in open air using a flux, powder metallurgy, and high pressure die casting.

The examples and embodiments described herein are for illustrative purposes only and various modifications or changes in light thereof will be suggested to persons skilled in the art and are included within the spirit and purview of this application. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

All patents, patent applications, provisional applications, and publications referred to or cited herein (including those in the "References" section) are incorporated by reference in their entirety, including all figures and tables, to the extent they are not inconsistent with the explicit teachings of this specification.

The description herein of any aspect or embodiment of the invention using terms such as "comprising", "having", "including" or "containing" with reference to an element or elements is intended to provide support for a similar aspect or embodiment of the invention that "consists of", "consists essentially of", or "substantially comprises" that particular element or elements, unless otherwise stated or clearly contradicted by context (e.g., a composition described herein as comprising a particular element should be understood as also describing a composition consisting of that element, unless otherwise stated or clearly contradicted by context).

The term "consisting essentially of," as used herein, limits the scope of the ingredients and steps to the specified materials or steps and those that do not materially affect the basic and novel characteristic(s) of the present invention, i.e., compositions having the relevant characteristics of the alloy.

REFERENCES

1. C. L. Mendis, C. J. Bettles, M. A. Gibson, C. R. Hutchinson, An enhanced age hardening response in Mg—Sn based alloys containing Zn. *Mater. Sci. Eng. A* 2006, 435-436, 163-171.
2. F. R. Elsayed, T. T. Sasaki, C. L. Mendis, T. Ohkubo, K. Hono, Compositional optimization of Mg—Sn—Al alloys for higher age hardening response. *Mater. Sci. Eng. A* 2013, 566, 22-29.
3. T. Bhattacharjee, C. L. Mendis, K. Oh-ishi, T. Ohkubo, K. Hono, The effect of Ag and Ca additions on the age hardening response of Mg—Zn alloys. *Mater. Sci. Eng. A* 2013, 575, 231-240.
4. Nayeb-Hashemi, A. A., and J. B. Clark. "The Mg—Sn (Magnesium-Tin) system." Bulletin of Alloy Phase Diagrams 5.5 (1984): 466-476.
5. Liu, Hongmei, et al. "The microstructure, tensile properties, and creep behavior of as-cast Mg—(1-10)% Sn alloys." Journal of Alloys and Compounds 440.1 (2007): 122-126.

We claim:

1. A magnesium alloy composition comprising tin in an amount between 0.1 and 3.5 atomic percent, titanium in an amount between 0.1 and 2.0 atomic percent, hafnium in an amount between 0.1 and 2.0 atomic percent, and a balance consisting essentially of magnesium.

2. The composition according to claim 1, further comprising one or more elements selected from niobium, molybdenum, and vanadium, the total amount of the elements other than magnesium and tin being 2.0 atomic percent or less.

3. The composition according to claim 1, being of a cast alloy.

4. The composition according to claim 3, further comprising one or more elements selected from niobium, molybdenum, and vanadium, the total amount of the elements other than magnesium and tin does being 2.0 atomic percent or less.

5. The magnesium alloy composition of claim 1, the amount of tin being 1.1 atomic percent.

6. The magnesium alloy composition of claim 1, wherein the amount of tin is 2.2 atomic percent.

7. The magnesium alloy composition of claim 1, the time-to-peak hardness measured in hours being reduced in comparison with an alloy comprising tin in an amount of between 0.1 and 3.5 atomic percent and a balance consisting essentially of magnesium.

8. The composition according to claim 1, the hafnium being present in an amount between 0.3 and 2.0 atomic percent.

9. The composition according to claim 1, the hafnium being present in an amount between 0.5 and 2.0 atomic percent.

* * * * *